United States Patent [19]

Inao

[11] 4,108,315

[45] Aug. 22, 1978

[54] CLOTHES POLE

[76] Inventor: Satoshi Inao, 646, Hachigasaki, Matsudo-shi, Chiba-Ken, Japan

[21] Appl. No.: 696,618

[22] Filed: Jun. 16, 1976

[51] Int. Cl.[2] ..... A47H 13/00

[52] U.S. Cl. ..... 211/124

[58] Field of Search ..... 248/307, 340, 221.4; 211/124

[56] References Cited

U.S. PATENT DOCUMENTS

| | | | |
|---|---|---|---|
| 685,647 | 10/1901 | Sborigi | 52/731 X |
| 699,971 | 5/1902 | Poschmann | 248/307 X |
| 2,787,435 | 4/1957 | Shields | 248/340 X |
| 2,880,949 | 4/1959 | Fuss | 248/307 UX |
| 3,214,122 | 10/1965 | Frederickson | 248/222.4 |
| 3,288,414 | 11/1966 | Fortunato | 248/223 |
| 3,297,290 | 1/1967 | Patterson | 248/223 |

FOREIGN PATENT DOCUMENTS

| | | | |
|---|---|---|---|
| 131,129 | 1/1949 | Australia | 211/124 |

*Primary Examiner*—William H. Schultz
*Attorney, Agent, or Firm*—Nolte & Nolte

[57] ABSTRACT

The present invention relates to improvements in a pole for hanging out washed clothes or the like wherein the washed clothes or the like are moved while being suspended therefrom, to a preferred longitudinal position by means of resilient suspending member and/or fixed firmly at any position thereof so that they are not slipped or blown off by wind or the like.

1 Claim, 7 Drawing Figures

CLOTHES POLE

BACKGROUND OF THE INVENTION

Normally, washed clothes or the like are hung out on or from a clothes pole or plastic rope by pins or pegs so that they are not slipped or blown off by wind or the like. However, according to a conventional type of clothes pole, fixation of the washed clothes or the like by such means has been insufficient so far. As a result, the washed clothes or the like tend to become wrinkled easily.

Further, it is not easy to move the washed clothes or the like being suspended from the clothes pole, toward any preferred position.

For the sake of removing the foregoing disadvantages of the conventional type of clothes pole, the instant invention has been achieved.

BRIEF SUMMARY OF THE INVENTION

The object of the present invention is to provide a clothes pole wherein washed clothes or the like are moved while being suspended therefrom, to a preferred longitudinal direction by means of resilient suspending member which is secured in a guiding space provided in the body of the clothes pole.

Another object of the present invention is to provide a clothes pole wherein washed clothes or the like being suspended therefrom are firmly fixed at any position so that they do not slipped off or are not blown off by wind or the like.

Another object of the present invention is to provide a clothes pole wherein washed clothes or the like are dried without becoming wrinkled owing to a preferred fixing means.

Another object of the present invention is to provide a clothes pole which is light weight, portable and inexpensive to manufacture.

Other objects and aspects of the present invention will appear more fully from the following description.

BRIEF DESCRIPTION OF THE DRAWINGS

FIG. 1(*b*) is a perspective view of a suspending member of the embodiment of FIG. 1(*a*).

FIG. 1(*c*) is an exploded end view of the embodiment of FIG. 1(*a*).

FIG. 2(*c*) is an underside view of a guiding means in which the suspending member of FIGS. 2(*a*) and (*b*) is secured.

DETAILED DESCRIPTION OF THE INVENTION

Figure 1:
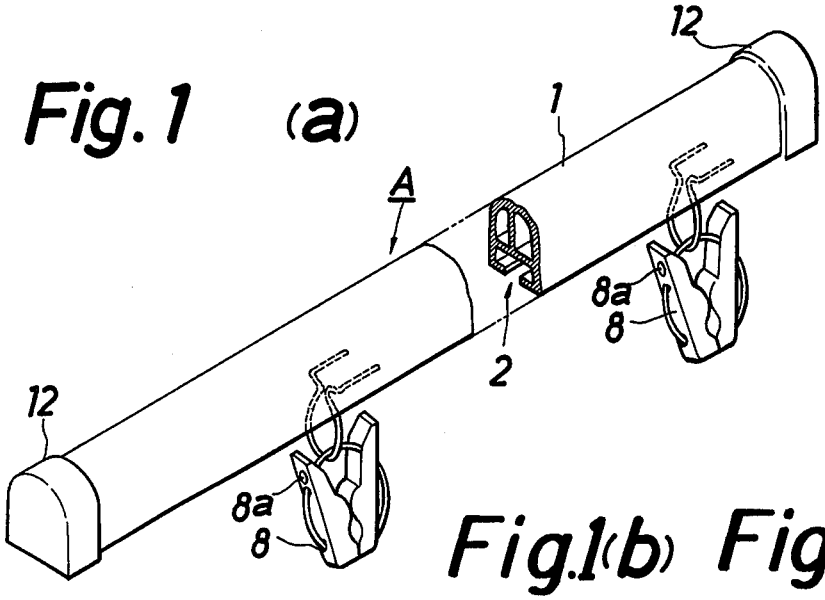
FIG. 1(*a*) is a partially cutaway perspective view of an embodiment of a clothes pole according to the present invention.
Figures 1B, 1C:
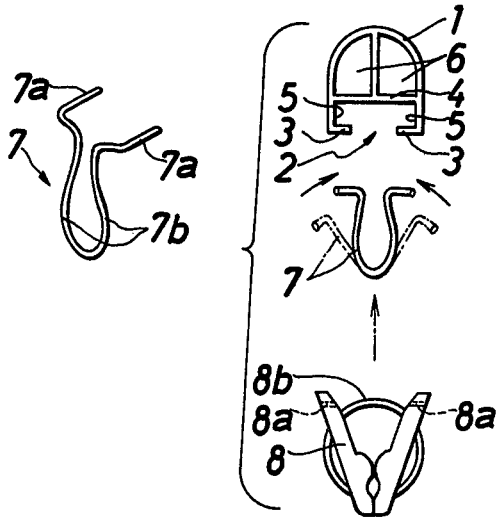

Referring first to FIG. 1(*a*), there is shown a body 1 of the clothes pole A of the instant invention. The body 1 is a longitudinal pole of a roughly hemispherical shape. At the lower portion of the pole 1 there is provided a guiding space 2 in a longitudinal direction. The guiding space 2 consists of a reverse T-shape beam 4, hook portions 3,3 and guiding sides 5,5. To lighten the weight of the pole 1, a cavity 6 is formed. Accordingly, it is easy to carry even a long-sized clothes pole. Numeral 7 denotes a suspending member which is made of a metal having spring as resilient characteristics. The suspending member 7 has a pair of parallel arms *7a, 7a,* and is bent at *7b* thereof. Accordingly, the pair of parallel arms *7a, 7a* of the suspending member 7 spring apart in the pole member to become firmly secured along the two opposite guiding sides 5,5. Numeral 8 denotes a clothes peg which is linked with the suspending member 7 through holes *8a, 8a* of the peg 8 or from below a spring *8b* thereof.

Figures 2A, 2B:
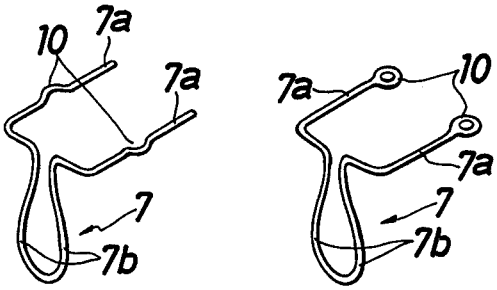
FIGS. 2(*a*) and 2(*b*) are each a perspective view of a suspending member of another embodiment according to the present invention.
Figure 2C:
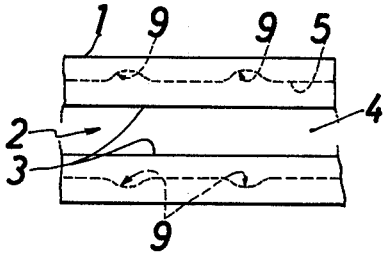

Each of FIGS. 2(*a*) and 2(*b*) shows another embodiment of a suspending member of the instant invention. FIG. 2(*c*) is an underside view of a guiding means in which the suspending member of FIG. 2(*a*) and FIG. 2(*b*) is secured. In this embodiment, there are provided a plurality of pairs of concave portions 9, 9 spaced along the guiding sides 5,5 on opposite sides thereof. On the other hand, in FIG. 2(*a*) and FIG. 2(*b*) there are provided two convex portions 10, 10 at the two parallel arms *7a, 7a.* Consequently, a pair of convex portions 10, 10 are interposed firmly in the corresponding concave portions 9,9. Accordingly, positioning of the suspending member 7 can be predetermined.

Figure 3:
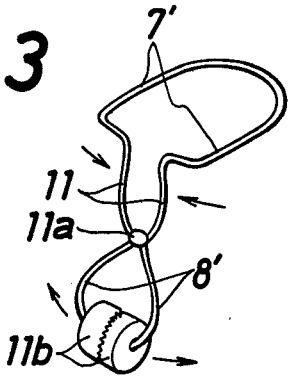
FIG. 3 is a perspective view of another embodiment in which a suspending member and a holding member are integral.

Referring to FIG. 3, there is shown another example in which a suspending member 7' and a holding member 8' are formed integrally by way of a hinge 11*a*. When forcing a grasping part 11 to a direction of two arrows 11*a*, two pieces 11*b* of the holding member 8' are separated from each other. Accordingly the washed clothes can be held by the two pieces 11*b*.

Preferably, the body 1 of the clothes pole A of the present invention is made of a preferred plastic material. Alternately, the body is made of aluminum alloy, in which the reverse T-shape beam can be installed.

Further, the hook portions 3, 3 can be modified as they are projecting outwardly. (This embodiment is not shown in the accompanying drawings.) Then, two arms of a modified suspending member are secured on the outwardly projecting hook portions. In this case, elastic stress is also applied to the modified suspending member, so that the same effect as the aforegoing embodiment can be attained.

The operational function of the clothes pole A according to the present invention will now be described. While pressing inwardly the just above the bend *7b* of the suspending member 7, the arms *7a, 7a* of the suspending member 7 are inserted in the guiding space 2 and when released attached to the guiding sides 5, 5 since the is released, the arms of the suspending member 7 spring apart and are firmly secured in the guiding space 2.

After a plurality of suspending members 7 are inserted in the guiding space 2 by the foregoing way, a pair of parallel arms *7a, 7a* of the suspending members 7 are movable or slidable along the guiding sides 5,5 by pressing inwardly the just above the bent portion *7b* of the suspending member 7. Once the stress above the bend is released, the arms *7a, 7a* are firmly fixed in the guiding space 2. Then, the washed clothes are held and suspended by a plurality of clothes pegs 8 which is linked with the suspending member 7 fixed as above. Accordingly, the washed clothes or the like do not slipped or are not blown off by wind. If a considerably larger washing such as a bed sheet is held by a plurality of clothes pegs 8, it is dried without making wrinkles.

As described previously, the suspending member which is inserted in the guiding space is moved or fixed therein because of the resiliency or springiness of the suspending member. Since the washed clothes or the like are held by a plurality of clothes pegs each linked with the suspending member, they are not affected by wind or the like. Further, positioning of the washed clothes is very easy by pressing the sides of the suspending member inwardly.

It is to be understand that the form of my invention shown and described is to be taken as a preferred example of the same and that various changes in the shape, size, arrangement of parts may be resorted to without departing from the spirit of my invention or the scope of the subjoined claims.

What is claimed is:

1. A clothes pole assembly comprising a body forming guiding means extending in a longitudinal direction and comprising a pair of upwardly facing spaced apart surfaces and a pair of laterally facing spaced apart surfaces, at least one suspending member comprising a pair of support arms and means for biasing said arms against said laterally facing surfaces, said upwardly facing surfaces constituting means for supporting said arms, said biasing means also comprising means depending from said arms for moving said arms toward and away from said laterally facing surfaces for moving said suspending member along said guiding means, and means for holding washed clothes including means linking said holding means to said depending means, said laterally facing surfaces and said arms including interfitting concave and convex portions for fixing said suspending member in position along said guiding means.

* * * * *